US005508592A

United States Patent [19]

Lapatovich et al.

[11] Patent Number: 5,508,592

[45] Date of Patent: Apr. 16, 1996

[54] METHOD FOR DEFLECTING THE ARC OF AN ELECTRODELESS HID LAMP

[75] Inventors: Walter P. Lapatovich, Marlborough; Scott J. Butler, North Oxford, both of Mass.; Jason R. Bochinski, Springfield, Oreg.; Harold H. Goss, Pelham, N.H.

[73] Assignee: Osram Sylvania Inc., Danvers, Mass.

[21] Appl. No.: 360,485

[22] Filed: Dec. 21, 1994

[51] Int. Cl.[6] ..... H05B 37/02; G05F 1/00

[52] U.S. Cl. ..... 315/248; 315/82

[58] Field of Search ..... 315/248, 82

[56] References Cited

U.S. PATENT DOCUMENTS 5,306,987 4/1994 Dakin et al. ..... 315/248

5,373,217 12/1994 Gregor ..... 315/248

*Primary Examiner*—Robert Pascal

*Assistant Examiner*—Michael Shingleton

*Attorney, Agent, or Firm*—William E. Meyer

[57] ABSTRACT

The present invention provides a method for using electrodeless high-intensity discharge (HID) lamps for automotive headlamp and similar applications requiring high/low beam operation (first and second beam orientation) of signaling. The HID lamp is excited with a high-frequency radio frequency (rf) signal. Modulation of the radio frequency signal is used to cause the arc of the HID lamp to selectively operate at an acoustic resonance point. At such a point, the arc undergoes a perturbation and is physically displaced from its quiescent position. When the lamp is placed at a focal or light-gathering point of an optical system having forward gain, displacement of the arc away from the focal point causes discernible changes in the far-field output of the optical system.

21 Claims, 9 Drawing Sheets

METHOD FOR DEFLECTING THE ARC OF AN ELECTRODELESS HID LAMP

FIELD OF THE INVENTION

This invention pertains to high-intensity discharge (HID) lamps for automotive applications and, more particularly, to electrodeless HID lamps excited by high (radio) frequencies and to methods using the inherent acoustic resonance frequencies of such a lamp's arc to alter the beam pattern thereof.

BACKGROUND OF THE INVENTION

Automobile manufacturers are constantly seeking rugged, long-lived and efficient light sources to replace the conventional tungsten filament headlamps. Automobiles are harsh environments for any light source. The headlamps used by the current technology must usually be replaced several times over the life of an automobile. The typical tungsten halogen lamps in use today allow only about 1000 starts and about 2000 hours of lamp operation before burnout. Automobile manufacturers perceive a need for a lamp allowing 5000 starts and 5000 hours of operation without losing a significant portion of the lamp's initial light. A 15 percent drop in lamp intensity over the life of a lamp is generally considered satisfactory.

Automobile headlamps are necessarily positioned along the front surface of a vehicle. These surfaces are the first surfaces which encounter wind resistance as a vehicle moves. Lamp faces are, therefore, important to the aerodynamic design of the vehicle. The large lamp faces heretofore used had to be sculpted to fit in a vehicle's over all aerodynamic design. Consequently, this has led away from the standardization of headlamps. Limiting the lamp face size could lead back to standardization of headlamps, and decreased lamp costs.

Creating small, rugged, long-lived and inexpensive lamps for automotive service is not simple. In constructing automotive headlamps meeting these criteria, plastic has been employed for lenses and reflectors. Inexpensive and easily moldable, the use of plastic suffers, however, from the possibility of its being melted when overheated. It is, therefore, necessary to create lamps of high efficiency which are less prone to overheating at a given light output. A typical automotive headlamp requires between 50 and 60 watts of power to produce an output of 1100 to 1320 lumens with an efficacy of about 22 lumens per watt. There is a need to do much better.

HID lamps used in automotive applications have usually been the electroded type. These lamps are usually produced by press-sealing a glass envelope around a pair of electrodes. While the unmelted portions of the lamp envelope are accurately controlled in manufacture, the wall thickness, wall angles and press seal may vary from lamp to lamp. A small but still significant portion of the lamp's light passes through or is reflected from the press seal, particularly in small or short lamps where the seal area forms a greater percentage of the sphere of illumination. These variations may result in uncontrolled deflections of light, resulting in glare. The glass envelope could be controlled by exacting control of manufacturing details, but this would result in increased costs. There is, therefore, a need for an inexpensive HID lamp having accurately controlled wall thickness and wall angles.

Such a lamp is described in U.S. Pat. No. 5,113,121 (assigned to the same assignee as the present application and issued to Walter P. Lapatovich et al) for ELECTRODELESS HID LAMP WITH LAMP CAPSULE, on May 12, 1992. Described therein is an electrodeless lamp which eliminates many of the aforementioned problems caused by sealing a glass envelope around electrodes. The patent features the use of a high-frequency power source to energize the lamp.

Another desirable feature for lamps employed in automotive forward lighting (headlamps) is their ability to alter the beam pattern for blinking or flashing the headlamps under certain circumstances. Such blinking or flashing might, for example, be desirable for signaling traffic when a vehicle is accelerating into a passing lane and passing slower traffic. Such "flash-to-pass" signaling is required in certain countries. It is also desirable to switch the far-field illumination pattern of a headlamp from high beam to low beam when approaching oncoming traffic or in conditions of foggy or rainy weather.

Numerous methods for providing for high/low beam operation have been used in automobiles. To provide these functions, the traditional tungsten filament headlamps were often provided with an independent pair of filaments, designed to be energized either individually or collectively. Some automobile manufacturers used four, individual, single-filament, sealed beam headlamp units, two high beam (right- and left-side) and two low beam.

It is known in the art that the arc pattern in either electroded or electrodeless HID lamps exhibits acoustic resonance. At such acoustic resonance points, the arc is perturbed, such as, forced out of its normal physical pattern. Acoustic resonance can be induced by using an exciting signal, generally in the sub-audio, audio and supra-audio range, depending on the size of the lamp. It has been the practice of designers to avoid operating HID lamps at or near acoustic resonance points.

In U.S. Pat. No. 4,170,746 (issued to John M. Davenport on Oct. 9, 1979, for HIGH FREQUENCY OPERATION OF MINIATURE METAL VAPOR DISCHARGE LAMPS), the problems of avoiding acoustic resonance bands in the design of miniature HID lamps are discussed. It is well known in the art that, when electroded HID lamps operate at 60 Hz, their efficiency is relatively low. This efficiency problem may be overcome by using higher excitation frequencies, usually 20 kHz to 50 kHz. It is also well known that certain resonant frequencies exist where the arc pattern becomes erratic. Davenport identifies three different resonance bands. In the first band, catastrophic instability of the arc occurs; the arc is forced to the wall of the lamp and will quickly melt through the wall. A second resonance band exists where the light output fluctuates and the arc wanders. At a third resonance band, the luminous aureole surrounding the arc is unstable. Davenport teaches the design of electronic ballasts that are adapted to avoid these resonance bands.

U.S. Pat. No. 4,983,889 (issued to Victor D. Roberts on Jun. 8, 1991, for DISCHARGE LAMP USING ACOUSTIC RESONANT OSCILLATIONS TO ENSURE HIGH EFFICIENCY), teaches the use of acoustic energy to thoroughly mix the fill ingredients in the envelope of an HID lamp. Roberts discusses the effects of acoustic energy at both resonant and non-resonant frequencies on the geometry of the arc. Roberts, however, does not teach the use of acoustic energy to move the arc to accomplish aforementioned blink or flash operations.

It is an object of the present invention to provide a small, high-efficiency, electrodeless HID lamp that is suitable for use in automotive headlamp applications.

It is a further object of the invention to operate an HID electrodeless lamp at or near an acoustic resonance point, to deflect the HID lamp arc in a controlled manner to accomplish a visibly discernible change in the far-field illumination thereof, when associated with an optical system having forward gain.

It is yet a further object of the invention to achieve an acoustic perturbation of a transient nature to achieve flash-to-pass signaling or of a sustained nature to achieve high/low beam switching from a single electrodeless HID lamp.

It is a still further object of the invention to provide an electrodeless HID lamp that has a long service life and a low initial cost.

SUMMARY OF THE INVENTION

A method for inducing acoustic resonance in the arc of an electrodeless high-intensity discharge lamp is disclosed. The lamp is excited by a radio frequency signal. When the radio frequency signal is modulated in an appropriate manner, acoustic resonance with an attendant displacement of the arc is achieved. When the lamp is coupled with an optical system having forward gain, a useful automotive headlamp system is obtained. High/low beam switching and/or flash-to-pass signaling are accomplished by controlling the amplitude and duration of the modulation of the radio frequency signal.

BRIEF DESCRIPTION OF THE DRAWINGS

A complete understanding of the present invention may be obtained by reference to the accompanying drawings, when taken in conjunction with the detailed description thereof and in which: V

DESCRIPTION OF THE PREFERRED EMBODIMENT

Figure 1:
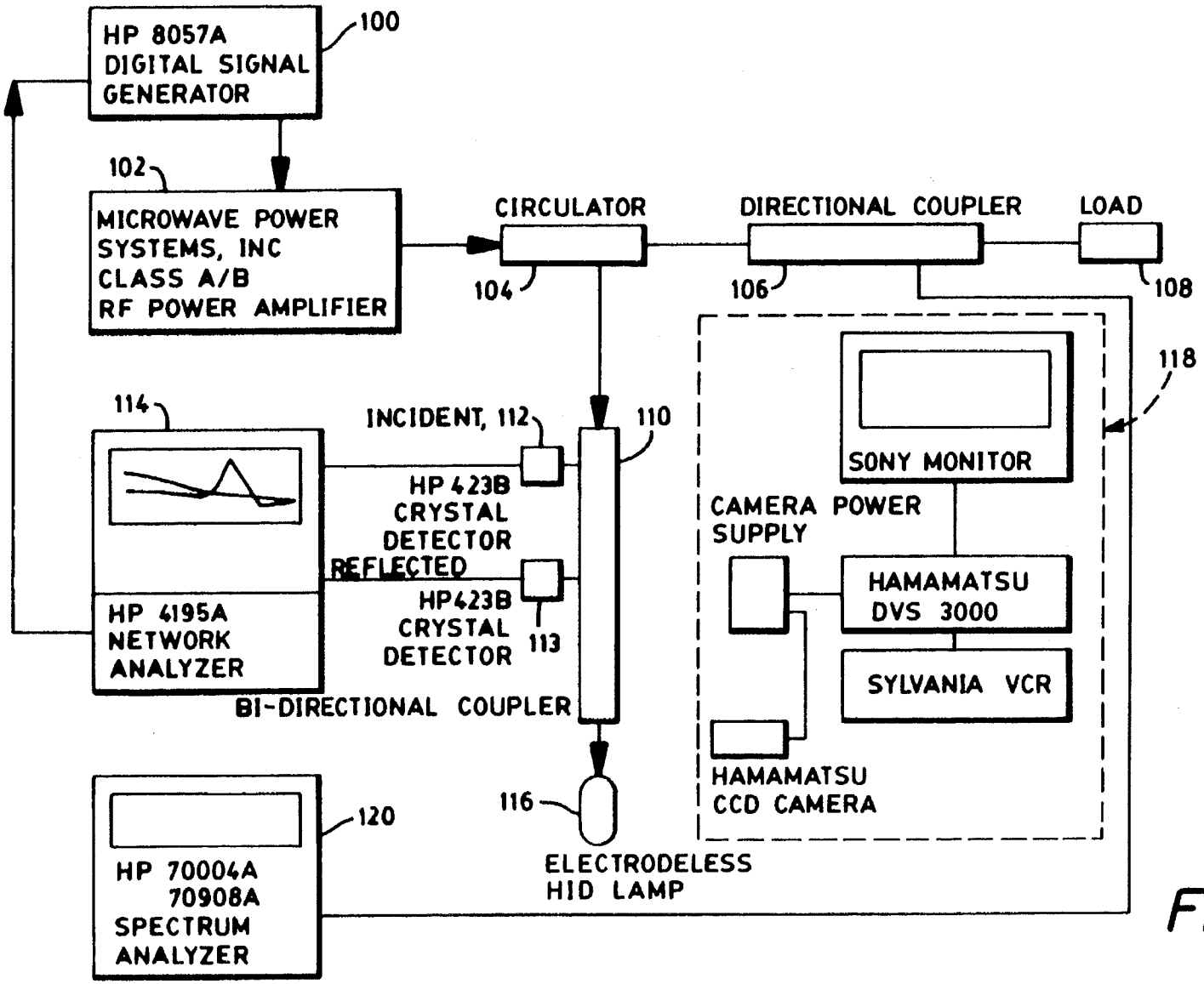
FIG. 1 is a schematic diagram of a test arrangement for the investigation of acoustic modulation effects on electrodeless HID lamps.

Referring first to FIG. 1, there is shown a schematic diagram of a test setup for the evaluation of the effects of acoustic perturbation on the arcs of electrodeless HID lamps. A radio frequency digital signal generator (such as a Hewlett Packard Model 8057A 100) may be used to generate a radio frequency (rf) signal. Signal generator 100 is capable of amplitude-modulating a radio frequency carrier, either continuously or in bursts. The carrier frequency and modulation characteristics of the generated radio frequency signal may be controlled by an external control signal, discussed in more detail below. The generated, modulated radio frequency signal may be amplified by a linear class AB radio frequency power amplifier 102. A suitable amplifier is manufactured by Microwave Power Equipment, Inc., as Model No. PAS-47-0-500/1000. The amplified radio frequency signal from amplifier 102 is directed to a circulator 104. A typical circulator is manufactured by Western Microwave as Model No. 3JA-Q075-915. The radio frequency output from circulator 104 is provided as input to bi-directional coupler 110. Any reflected energy at this point in the system flows back through the circulator and flows through a directional coupler 106 to an appropriate load 108. Directional and bi-directional couplers are well-known in the art; any device appropriate to the selected frequency range may be employed. A pair of crystal detectors 112, 113 is disposed at outputs of bi-directional coupler 110. Model 423B crystal detectors from Hewlett Packard are employed. One of the crystal detectors 112 may be attached to bi-directional coupler 110 to measure the forward power. The other crystal detector 113 may be connected to bi-directional coupler 110 to measure the reflected power. The actual power being delivered to lamp 116 may be calculated by subtracting reflected power from forward power as detected by crystal detectors 112, 113. Detected signals from crystal detectors 112, 113 which recover the modulation information are provided as input to a network analyzer 114. A Hewlett Packard Model 4195A network analyzer has proven suitable. Network analyzer 114 also provides a sweep control signal which is applied to signal generator 100. This sweep control signal allows sweeping through a predetermined acoustic frequency range and plotting amplitude and/or phase versus frequency plots of an HID lamp under test. The major portion of the radio frequency signal from bi-directional coupler 110 is applied to an electrodeless HID lamp under test 116, using a suitable coupling means as is well known in the art. A visual monitoring system, shown generally at reference numeral 118, is provided to monitor the light output level, arc shape and beam directional characteristics of lamp 116 under test. Monitoring system 118 may comprise a CCD camera with appropriate power supply, a Digital Video System (DVS) a conventional VCR and a video monitor. A Hamamatsu camera, Model No. C3077 has proven satisfactory for this application, as has Hamamatsu DVS Model DVS-3000. Finally, a spectrum analyzer 120 monitors a portion of the amplified radio frequency signal output from directional coupler 106. A Hewlett Packard Model 70004A/70908A spectrum analyzer has been employed to monitor this reference signal.

Microwave excitation of electrodeless HID lamps is well known in the art. While there have been many frequencies used for lamp excitation, common frequency bands often employed are the ISM bands centered at 13.5 megahertz, 40 megahertz, 915 megahertz or 2450 megahertz. It has been found that the method of the present invention operates effectively in the 902 megahertz to 928 megahertz band and, for purposes of disclosure, a frequency of approximately 915 megahertz has been chosen. Modulation frequencies in the range of 10 kHz to 600 kHz have been applied to the 915 megahertz carrier frequency. The method of the present invention has been found to be essentially independent of the carrier frequency employed and, therefore, may be used at frequencies in any of the four ISM bands identified hereinabove.

Figure 2:
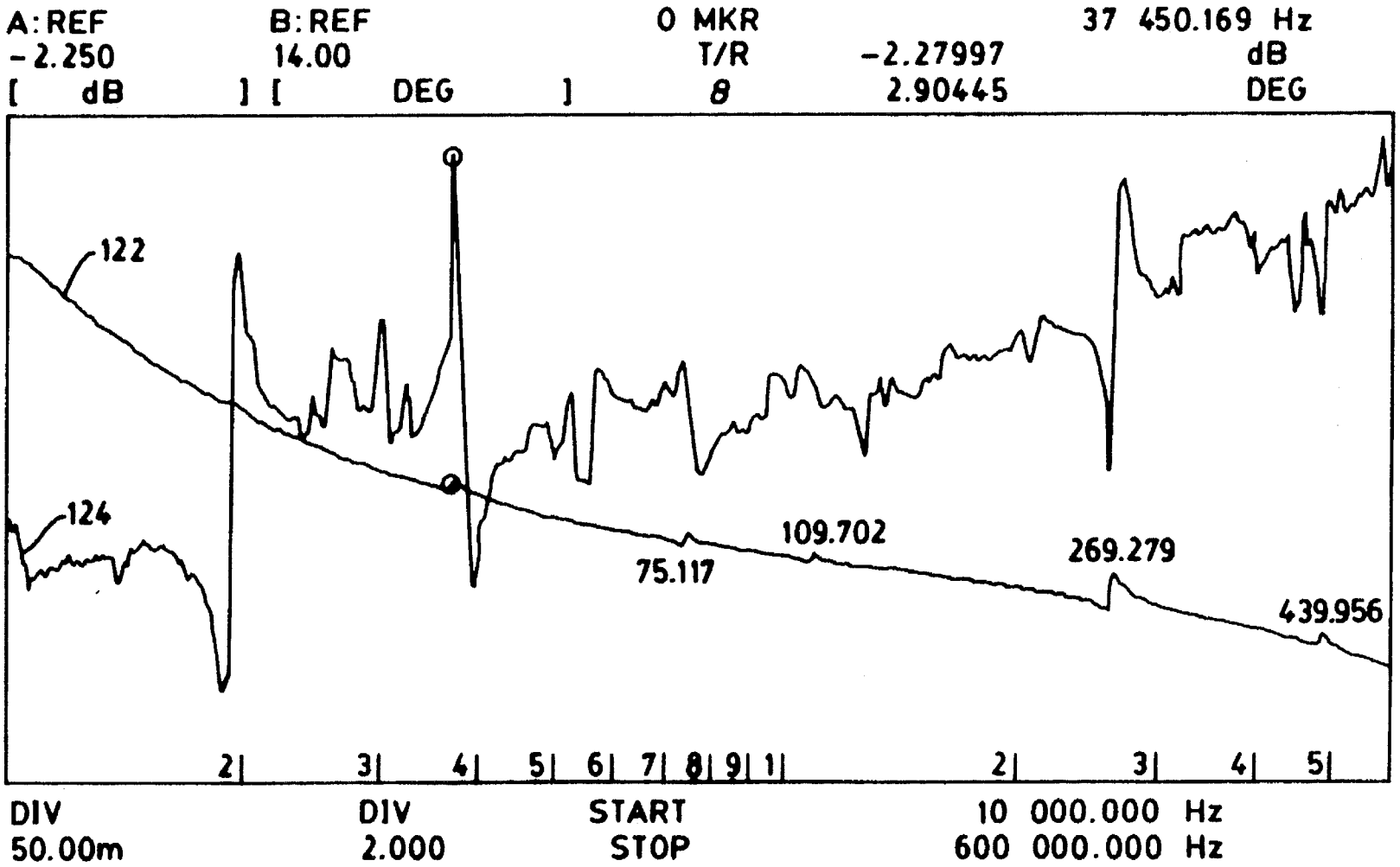
FIG. 2 is a plot of the amplitude and the phase of acoustical signals, as measured by the test arrangement of FIG. 1.

Referring now to FIG. 2, there is shown an amplitude and phase response versus modulation frequency plot for a typical electrodeless HID lamp. The amplitude 122 and phase 124 of the returned signal as measured by crystal detector 113 is displayed relative to the amplitude and phase of the input signal measured by the crystal detector 112. The vertical scale for the amplitude is in dB, and the phase is in degrees. The significance of the chart is shown by the simultaneous occurrence of perturbations in both amplitude and phase which occur as the modulation frequency is swept through a resonance. A simultaneous perturbation at a resonance is indicated with the circular markers at about 37.450 kHz. By sweeping the modulation frequency, a resonance map is constructed that shows perturbations occurring at the resonance frequencies for the input signal. Several resonant peaks are readily identified in both the amplitude and phase curves. At these discontinuities, acoustical perturbation of the arc occurs. These resonant peaks correlate with visual observations and photographic recordings of deflections of the arc.

Resonance characteristics of a particular HID lamp are dependent upon both the lamp's geometry and fill chemistry, such as the particular mix of metals and gases present in the lamp envelope. A typical electrodeless HID lamp has nominal dimensions of 2 millimeters inner diameter, 3 millimeters outer diameter, and about 10 millimeters length and may be filled with a typical metal halide arc chemistry comprising sodium-scandium-iodide (a volatizable salt), mercury and argon. Molar concentrations of sodium to scandium generally are the range of 20:1 to 0.5:1. Resonance frequencies occur for modes in three dimensions. These modes are usually labeled radial, azimuthal and longitudinal for cylindrical lamps.

The useful chemistry in the lamp is not limited to the mercury, argon and sodium-scandium-iodide one listed. Other inert gases may be used, and other volitizable dopants may be used. Changing the chemistry has subtle effects on the resonant frequency. First the temperature distribution in the arc changes, second the average of the molecular mass of vapor changes. These affect the speed of sound through the capsule, resulting in differing harmonic resonances for the same lamp dimensions. It should be understood that the first or fundamental longitudinal harmonic is generally dominant. The subsequent longitudinal, and the radial and azimuthal harmonics have lesser affects. The fundamental frequencies, longitudinal, radial and azimuthal are given respectively by the following formulas:

$$f_l=(c/2L)k$$

$$fr=(1.84c/2\pi r)n$$

$$fa=(3.83c/2\pi r)m$$

where:

c=the velocity of sound in the enclosed media, at the temperature and pressure of operation l=the inside longitudinal dimension of the tube r=the inside radius of the tube k, n, m=integers equal to or greater than 1. These formulas for cylindrical arc tubes are well known in the art and described by H. L. Witting, J. of Applied Physics 49 (5) May 1978, pp 2680–2683. Similar formulas exist for spherical, and other well defined cavities.

Figure 3:
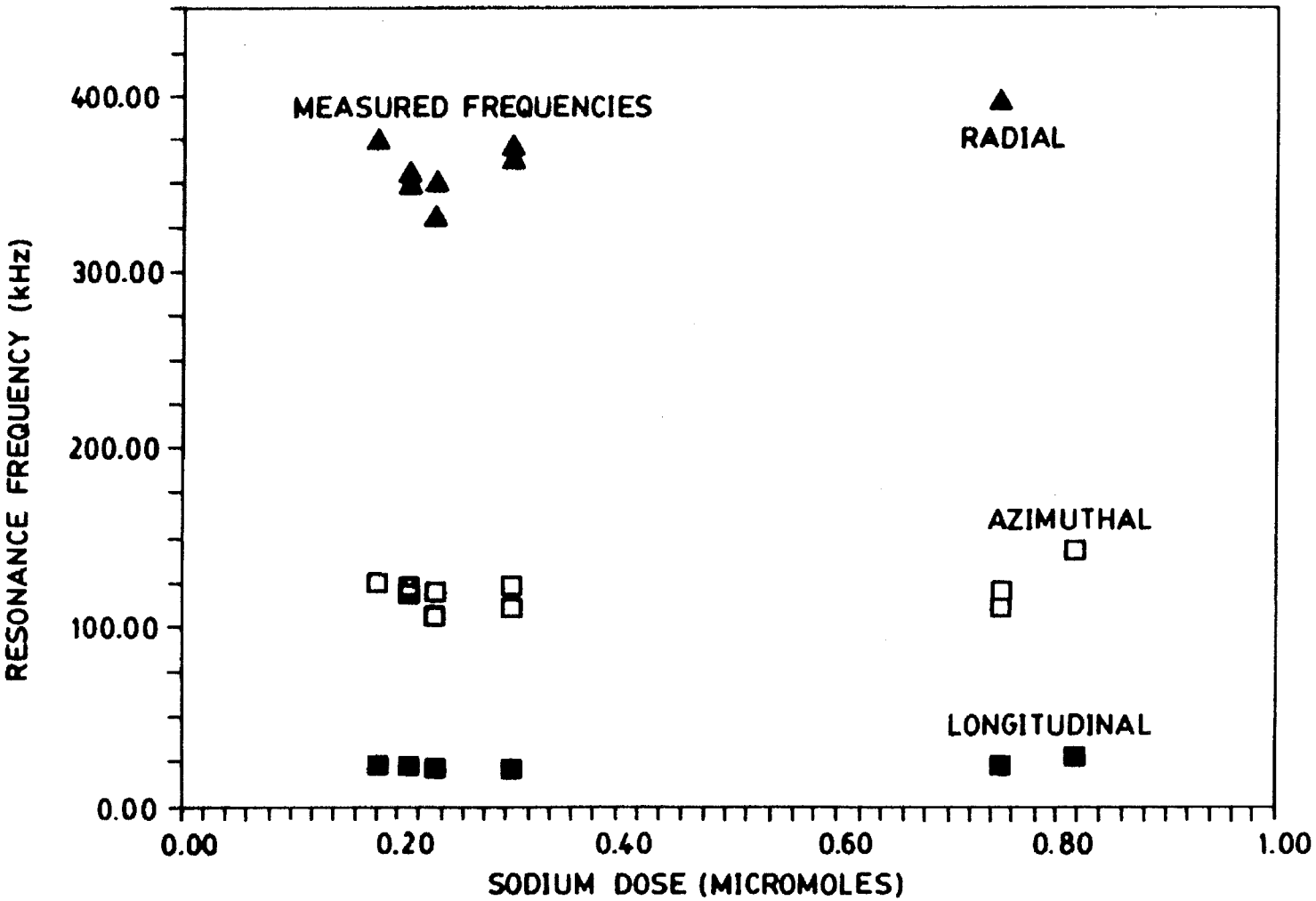
FIG. 3 is a graph of the radial, azimuthal and longitudinal acoustic resonance frequencies for several lamps as a function of sodium dose.

A number of lamps of nearly identical geometries were tested, each containing approximately the same amount of mercury. The sodium concentration varied from lamp to lamp. A plot of radial, azimuthal and longitudinal mode resonance frequencies for the lamps is shown in FIG. 3. Generally, the resonant frequency for each mode was generally fixed by the lamp dimension. There is some shifting of resonant peaks with the changing sodium dose (expressed in micromoles) as may be observed.

Figure 4:
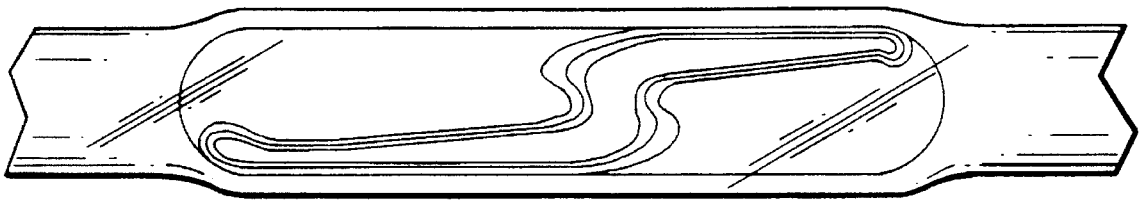
FIG. 4 is an arc pattern image showing displacement during the first longitudinal resonance, using the test arrangement of FIG. 1.
Figure 5:
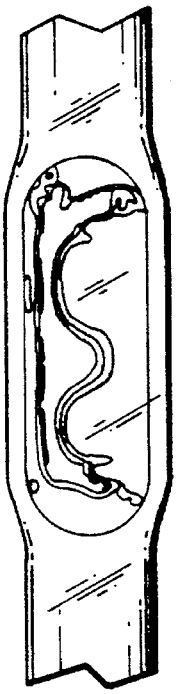
FIG. 5 is an arc pattern image showing displacement during the first azimuthal resonance, using the test arrangement of FIG. 1.
Figure 6:
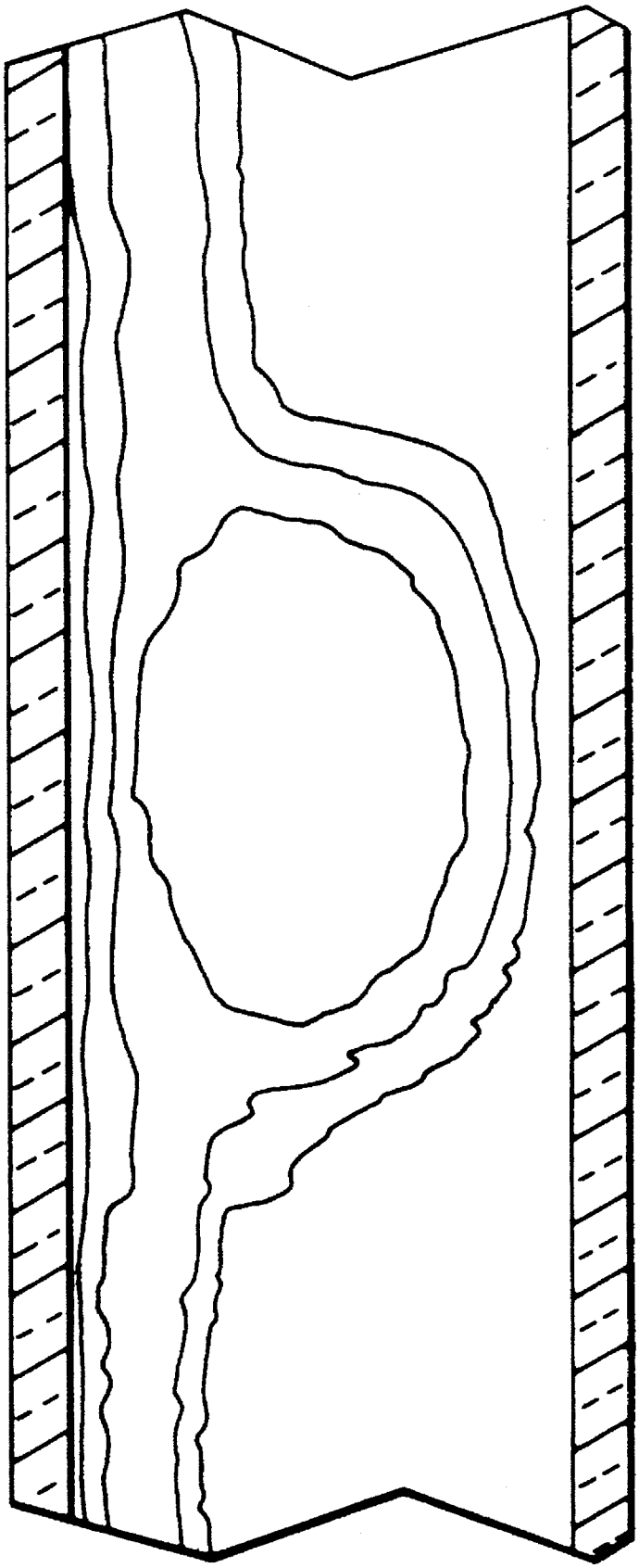
FIG. 6 is an arc pattern image showing displacement during the first radial resonance, using the test arrangement of FIG. 1.
Figure 7B:
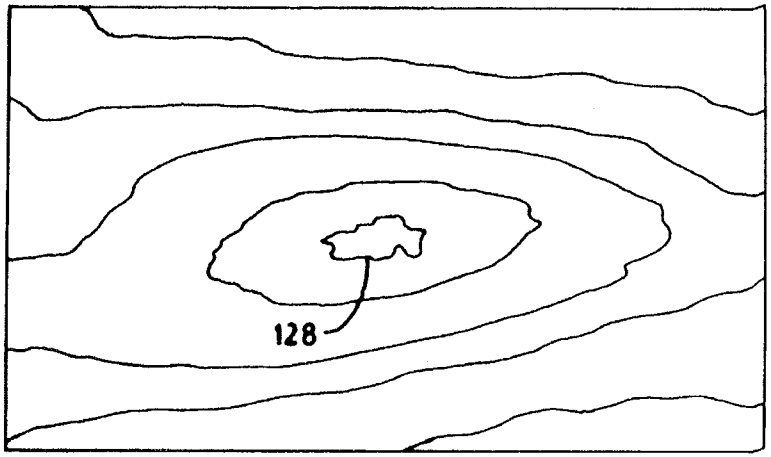
FIG. 7*b* is an image of the beam pattern of an electrodeless HID lamp operated at a non-resonance point.
Figure 7A:
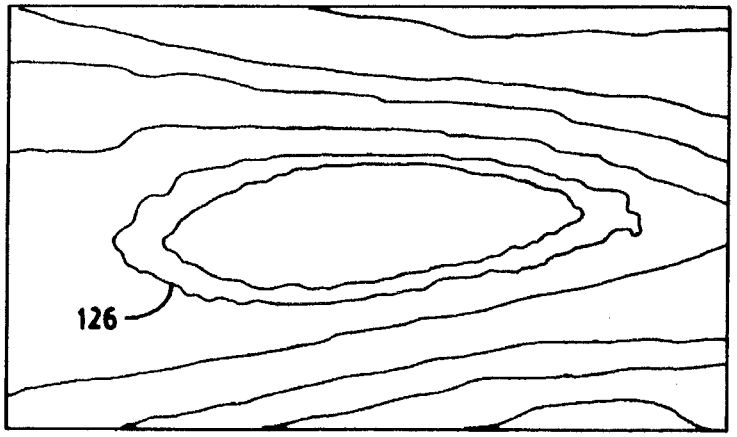
FIG. 7*a* is an image of the beam pattern of an electrodeless HID lamp operated at an acoustic resonance point.

Referring now to FIGS. 4, 5 and 6, images taken from photographs are shown of three arcs of electrodeless HID lamps displaced from the arc tube axis by acoustical perturbation. The lamp tube is shown in phantom. An unperturbed arc normally lies approximately along the tube axis in a nearly straight, or slightly bowed up arc with the maximum displacement from the tube axis about equal to about one half of the inner radius. FIG. 4 is an arc pattern image showing displacement at the second longitudinal resonance, using the test arrangement of FIG. 1. The arc shows an "S" or stair step configuration that is clearly deflected from the axis. FIG. 5 is an arc pattern image showing displacement at the first azimuthal resonance, using the test arrangement of FIG. 1. The arc is pressed against a side of the arc tube, with the ends and center curved up to form something of a "W" shaped arc. FIG. 6 is an arc pattern image showing displacement at the first radial resonance, using the test arrangement of FIG. 1. The arc is pressed against a side of the tube, with a single central bulge or hump.

In the suggested vehicle lamp tube, the maximum displacement from the tube axis is about one tube inner radius, or in the case of an electrodeless lamp suitable for automotive headlamp service, this displacement is approximately 1 millimeter. If the arc is placed at or near the focus of an optical element, such as a vehicle reflector, a 1 millimeter displacement of the arc is sufficient to cause a substantial shift in the projected image. With appropriate optics, an arc shift of one millimeter is capable of producing a large shift in the far-field illumination pattern on a plane surface, such as a roadway. The acoustically deflected arc may then be used in a vehicle headlamp to form high and low beams.

Performing a simple calculation, using the well-known thin lens equation for an arc at the focus of a refractive lens assembly, the shift in image distance, $\delta d_i$, may be calculated as:

$$\delta d_i=\frac{-f^2}{(d_o-f)^2}(\delta d_o) \quad (1)$$

where, $\delta d_0$ is the change in the object distance, or, in this case, the displacement of the arc by acoustical perturbation, and f is the focal length of the refractive lens. Note that, although a simple refractive optical system giving some forward gain or collimation is used for purposes of disclosure, one skilled in the art might apply the inventive method to a reflective imaging or non-imaging optical system such as is taught in U.S. Pat. No. 4,956,759 (issued to Jill F. Goldenberg et al on Sep. 11, 1990) for ILLUMINATION SYSTEM FOR NON-IMAGING REFLECTIVE COLLECTOR.

For an optical system to properly collimate the light from an HID lamp, the object distance must be close to the focal length. When this is so, a beam is cast essentially at an infinite distance. Infinity is approximated by about 30 meters for an automotive headlamp. By applying Equation 1 with an assumed focal length f=4.0 centimeters, an object distance of 40.053 millimeter and an assumed arc deflection of 0.5 millimeter ($\delta d_o$=0.5 millimeter), the magnitude in the change in the image distance may be shown to be about $d_i$=285 meters. This is a substantial shift and implies that a flash induced by a transient acoustic perturbation should be noticeable. It should also be clear that very small arc deflections would be required for sustained low beam/high beam operations. The implication is that the necessary acoustical perturbation required for this steady state operation could be maintained essentially indefinitely.

Referring now to FIGS. *7a* and *7b*, there are shown images of the forward beam patterns cast by an electrodeless lamp mounted in a vehicle reflector and lens assembly suitable for installation in an automobile. The electrodeless lamp capsule was positioned in the reflector so the arc would be at or near the focal point of the reflector when unmodulated, and would be displaced from the focal point when modulated. FIG. *7a* shows the forward beam pattern when the lamp is operated with a 35 percent modulation depth and a modulating frequency of 36 kHz. For the lamp, this amounts to the second harmonic of the longitudinal resonance. The arc is then deflected from the nearly straight axial position. Line 126 traces a isoillumination level. The central beam pattern is then diffused over a broader area in a way that would be useful for a low beam headlamp.

FIG. *7b* shows the beam pattern cast by the same lamp under the same conditions as in FIG. *7a*, except the lamp is operated at a non-resonant frequency that is just with the pure carrier and no modulation. The arc is then not displaced. Line 128 traces the same isoillumination level as in FIG. *7a*. FIG. *7b* shows a more concentrated hot-spot suitable for high beam applications. It has been shown that a 15–27 percent decrease in illumination at the hot-spot center may be achieved by varying the modulation percentage of the radio frequency carrier in the range of 20 percent to 50 percent.

While a longitudinal resonance has been chosen for purposes of disclosure, it should be obvious to those skilled in the art that azimuthal or radial resonance modes (as shown in FIG. 3) would not be outside the scope of the present invention. The characteristics of the alternative resonance modes could be measured by using the apparatus of FIG. 1 and with results like those shown in FIG. 3 obtained. It is also theoretically possible to calculate these modes for different lamp geometries, as taught by Harold L. Whiting in "Acoustic Resonances in Cylindrical High-Pressure Arc Discharges", Journal of Applied Physics 49(5), May 1978, pp. 2680–2683. Calculation of resonant frequencies is possible for non-cylindrical lamps, as well.

Figure 8:
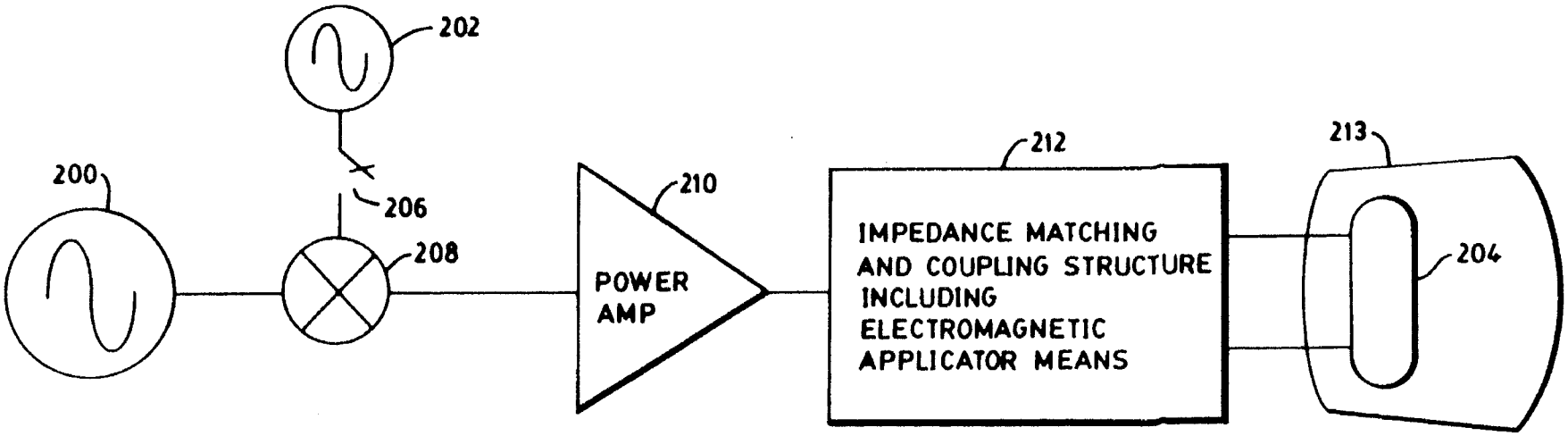
FIG. 8 is a schematic diagram of an electrodeless HID lamp and the necessary exciting circuitry for an automotive headlamp application.

Referring now to FIG. 8, there is shown a schematic diagram illustrating a typical automotive headlamp system with means for arc deflection by acoustic perturbation. A radio frequency oscillator 200 produces a radio frequency signal at a frequency of 915 megahertz. A modulation oscillator 202 produces a modulating signal at a frequency chosen to be compatible with a resonant mode in an electrodeless HID lamp 204. An output signal from modulation oscillator 202 is coupled through a switch 206 to an input of modulator/mixer 208. The output of radio frequency oscillator 200 is applied to another input of modulator/mixer 208. Closing switch 206 applies a modulating signal to modulator/mixer 208. A resultant modulated signal is applied to the input of power amplifier 210. When switch 206 is open, no modulating signal is applied to modulator/mixer 208; the signal applied to the input of power amplifier 210 is an unmodulated radio frequency signal. An amplified output signal is provided by power amplifier 210, which is applied to network 212. Network 212 performs a variety of functions, including impedance matching and coupling. The means for application of the electromagnetic field to electrodeless HID lamp 204 is assumed, in this schematic, to be included in network 212. The electrodeless HID lamp 204 may be positioned in a vehicle headlamp reflector and lens assembly 213 so the unmodulated arc is close to or at the focal point of the reflector, and when modulated, the arc is moved closer or farther from the focal point. When the signal applied to lamp 204 is unmodulated (that is, switch 206 is open), the normal, unperturbed operation of lamp 204 occurs, resulting in high beam operation. The application of a modulated signal to lamp 204 results in perturbance of the arc, with low beam operation resulting. The momentary closure of switch 206 results in a flash, just as in a conventional tungsten halogen headlamp system. Switch 206 is represented as a manual switch for purposes of disclosure. However, it will be obvious to those skilled in the art to substitute many forms of switches, including electronic switches that are controlled by external signals. A typical application would be the use of an electronic switch coupled to a photosensitive transducer for the automatic dimming of headlamps, when oncoming traffic is detected.

Amplitude modulation of the radio frequency carrier signal has been assumed for purposes of disclosure. It will be obvious to anyone skilled in the art that frequency modulation (fm) or pulse width modulation (pwm) may also be employed to cause acoustic perturbance of the arc of an electrodeless HID lamp.

Figure 9:
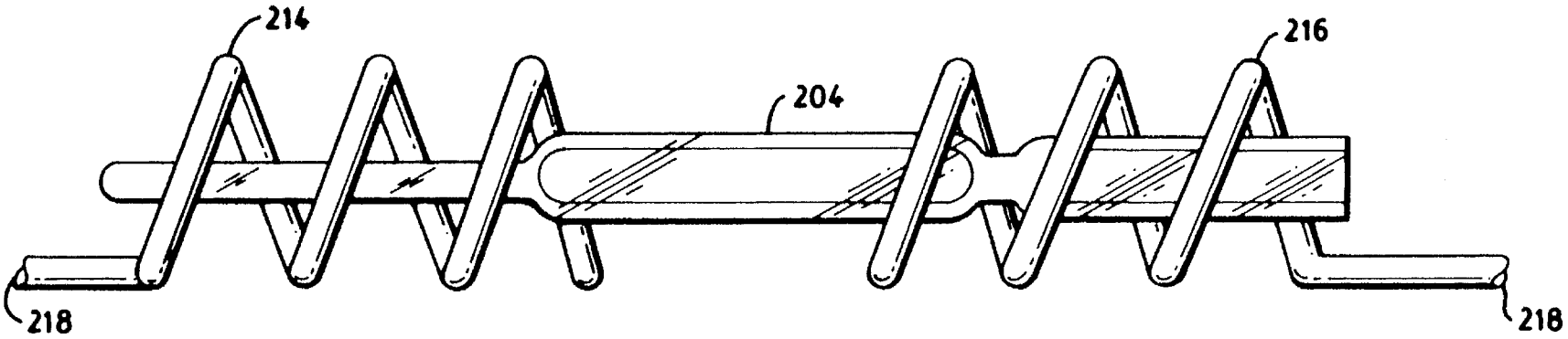
FIG. 9 is a plan view of a typical electrodeless HID lamp with typical applicators for coupling a high-frequency radio frequency signal to the lamp.

A typical applicator arrangement may be seen in FIG. 9. Electrodeless HID lamp 204 is shown, with a pair of applicators 214 and 216 encircling the envelope of lamp 204 proximate its distal ends. Applicator 214 may be seen to be physically arranged in an opposing manner relative to applicator 216. This arrangement allows the application of a radio frequency excitation signal in an antiphasal manner to lamp 204. Lead ends 218 are provided for the connection of applicators 214 and 216 to a source of radio frequency energy from an impedance matching device (not shown). A loop applicator, as disclosed in U.S. Pat. No. 5,130,612, issued Jul. 14, 1992, may be more efficient and convenient for inserting and removing lamp capsules. A thin shell type applicator, as disclosed in application USSN 08/099,754, filed Jun. 30, 1993, may also be more efficient.

Figure 10:
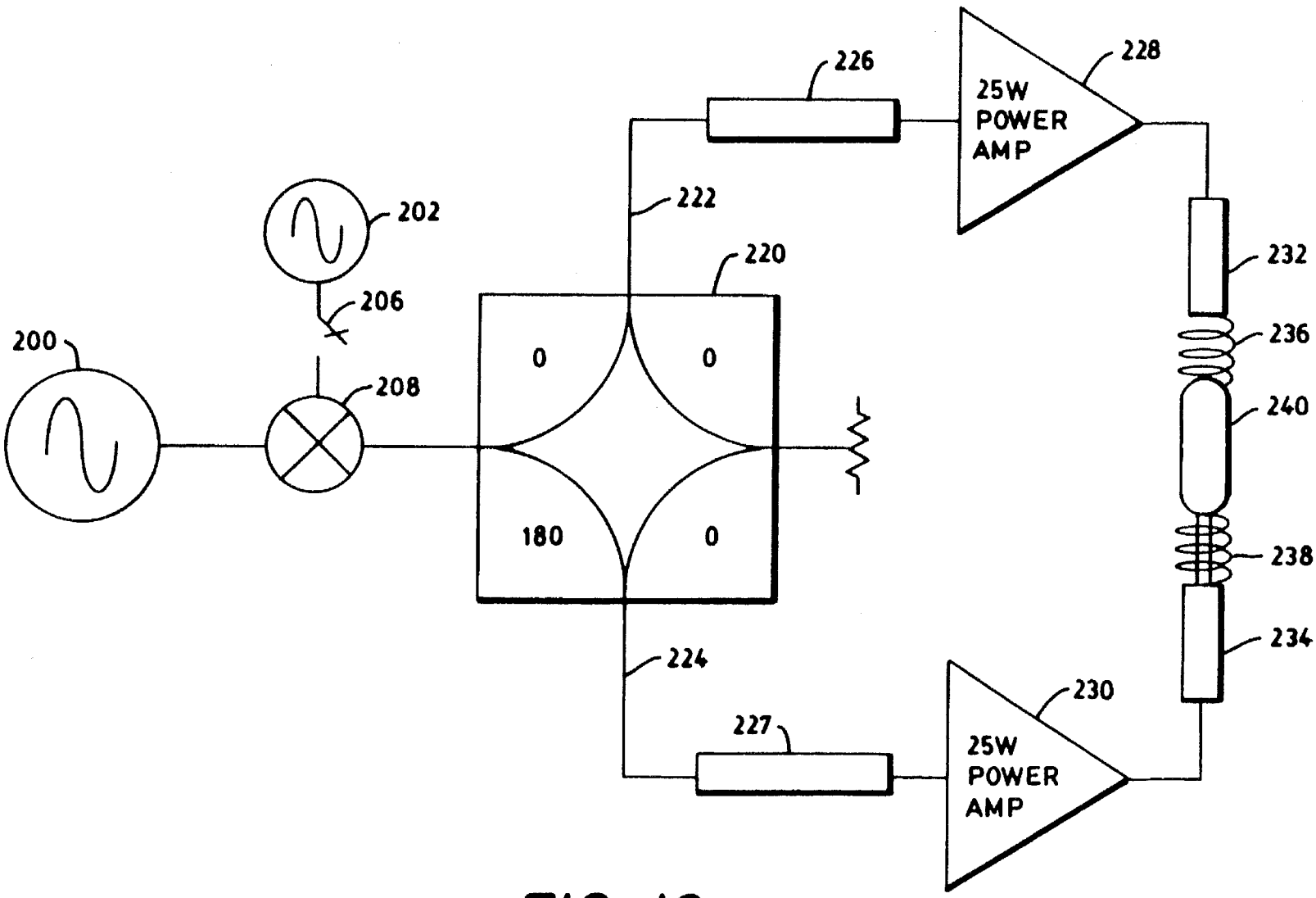
FIG. 10 is a schematic of an electrodeless HID lamp of a higher wattage rating than is required for automotive headlamp service, showing the necessary circuitry for exciting the lamp.

While the arrangement shown in FIG. 9 is satisfactory for low power (typically less than 30 watts) applications, a more sophisticated arrangement must be employed to practice the method of the present invention with higher-wattage HID lamps. Referring now to FIG. 10, there is shown a schematic of a system for applying the method of the present invention to higher-wattage electrodeless HID lamps. A radio frequency oscillator 200, modulation oscillator 202, switch 206 and modulator/mixer 208 function identically to the lower-power system described hereinabove. The output of modulator/mixer 208 is coupled to a 180 degree hybrid power divider. Power divider 220 splits the input signal into two out-of-phase components, an in-phase signal 222 and an out-of-phase signal 224. Signals 222 and 224 are provided as inputs to linear power amplifiers 228, 230 via micro stripline transmission lines 226 and 227 respectively. Micro stripline is well known in the art and any commercially available transmission media such as planar, coaxial, twin-line, waveguides and similar means may be used. Amplifier 228 amplifies the in-phase component of the signal, while amplifier 230 amplifies the out-of-phase component of the signal. Outputs of amplifiers 228 and 230 are connected to impedance matching networks 232, 234 and then to couplers 236, 238 for providing an electromagnetic field for exciting electrodeless HID lamp 240.

An automotive headlamp application has been chosen for disclosure. It is obvious that the use of acoustic perturbation to deflect the arc of an electrodeless HID lamp (in cooperation with a suitable optical system) may be employed for any application where change of intensity of the collimated light output is required. Other applications could be searchlights or ship-to-ship signaling.

Since other modifications and changes varied to fit particular operating requirements and environments will be apparent to those skilled in the art, the invention is not considered limited to the example chosen for purposes of disclosure, and covers all changes and modifications that do not constitute departure from the true spirit and scope of this invention. Having thus described the invention, what is desired to be protected by patent is presented in the subsequently appended claims.

What is claimed is:

1. A method for deflecting the arc discharge within an electrodeless HID arc lamp, comprising:

a) providing an electrodeless HID arc lamp having an arc discharge disposed at a predetermined location therein in its quiescent state, said arc discharge having at least one acoustical resonance frequency, at which said arc discharge is displaced from said quiescent location;

b) applying a radio frequency signal to said lamp to initiate and sustain the arc discharge thereof; and c) modulating said radio frequency signal to cause acoustic resonance at said at least one acoustical resonance frequency and to deflect said arc discharge from said quiescent location thereof.

2. The method for deflecting the arc discharge within an electrodeless HID arc lamp, as recited in claim 1, wherein said electrodeless HID arc lamp is substantially cylindrical.

3. The method for deflecting the arc discharge within an electrodeless HID arc lamp, as recited in claim 1, wherein said radio frequency is amplitude-modulated.

4. The method for deflecting the arc discharge within an electrodeless HID arc lamp, as recited in claim 1, wherein said radio frequency is frequency-modulated.

5. The method for deflecting the arc discharge within an electrodeless HID arc lamp, as recited in claim 1, wherein said radio frequency is pulse-width-modulated.

6. A method for using an electrodeless HID arc discharge lamp in an optical system, comprising:

a) providing an electrodeless HID arc lamp having an arc discharge disposed at a predetermined location therein in its quiescent state, said arc discharge having at least one acoustical resonance frequency, at which said arc discharge is displaced from said quiescent location;

b) placing said lamp proximate an optical system so that the quiescent arc discharge of said lamp is proximate a predetermined position of said optical system;

c) applying a radio frequency signal to said lamp to initiate and sustain the arc discharge thereof; and d) modulating said radio frequency signal to cause acoustic resonance at said at least one acoustical resonance frequency and to displace said arc discharge from said quiescent location thereof.

7. The method for using an electrodeless HID arc discharge lamp in an optical system, as recited in claim 6, wherein said optical system is non-imaging, and wherein said predetermined position of said optical system is an optimal light-gathering position.

8. The method for using an electrodeless HID arc discharge lamp in an optical system, as recited in claim 6, wherein said predetermined position of said optical system is a focal point.

9. The method for using an electrodeless HID arc discharge lamp in an optical system, as recited in claim 8, wherein said radio frequency is within a permitted ISM band.

10. The method using an electrodeless HID arc discharge lamp in an optical system, as recited in claim 9, wherein said permitted ISM band of operation is selected from permitted ISM bands centered at 13.5 megahertz, 40 megahertz, 915 megahertz or 2450 megahertz.

11. A method for using an electrodeless HID arc discharge lamp in an optical system, comprising:

a) providing an electrodeless HID arc lamp having an arc discharge disposed at a predetermined location therein in its quiescent state, said arc discharge having at least one acoustical resonance frequency, at which said arc discharge is displaced from said quiescent location;

b) determining an acoustic resonance frequency of said arc discharge;

c) placing said lamp proximate an optical system so that the quiescent arc discharge of said lamp is proximate a predetermined position of said optical system;

d) applying a radio frequency signal to said lamp to initiate and sustain the arc discharge thereof; and e) modulating said radio frequency signal to cause acoustic resonance at said at least one acoustical resonance frequency and to displace said arc discharge from said quiescent location thereof.

12. The method for using an electrodeless HID arc discharge lamp in an optical system, as recited in claim 11, wherein said acoustic resonance frequency is determined by measurement.

13. The method for using an electrodeless HID arc discharge lamp in an optical system, as recited in claim 11, wherein said acoustic resonance frequency is determined by calculations dependent upon the geometry of said lamp.

14. A method of operating an electrodeless lamp having a tubular envelope containing an arc discharge light source, the tubular envelope having with an internal length L, and a internal radius of R, the lamp being powered by radio frequency input power, the tubular source being positioned in an optical system having a focal point, the method comprising switching the input power from a nonresonant driving condition to a resonant frequency driving condition thereby causing the arc discharge to shift location with respect to the focal point.

15. The method in claim 14, wherein the resonant frequency driving condition is determined by the formula:

$$f_1=(c/2L)k$$

where:

c=the velocity of sound in the enclosed media, at the temperature and pressure of operation k=an integer equal to or greater than 1.

16. The method in claim 14, wherein the resonant frequency driving condition is determined by the formula:

$$f_a=(1.84c/2\pi R)n$$

where:

c=the velocity of sound in the enclosed media, at the temperature and pressure of operation n=an integer equal to or greater than 1.

17. The method in claim 14, wherein the resonant frequency driving condition is determined by the formula:

$f_r=(3.83c/2\pi R)m$ where:

c=the velocity of sound in the enclosed media, at the temperature and pressure of operation m=an integer equal to or greater than 1.

18. An electrodeless lamp system comprising:

a) an optical system for projecting light from a region of a focal point for the optical system, b) an electrodeless lamp having a tubular envelope having with an internal length L, and a internal radius of R, enclosing a chemical system susceptible to radio frequency power excitation to light emission in the form of an arc discharge with a temperature and pressure, the envelope being positioned in the region of the focal point of the optical system;

c) a radio frequency power source and delivery system to power the electrodeless lamp, the power source and delivery system in a first condition providing power not stimulating acoustic resonance of the chemical system in the tubular envelope at the temperature, and pressure of lamp operation, and in a second condition providing power at an acoustically resonant frequency to the lamp, and d) a switch for shifting the power source from the first condition to the second condition whereby the arc discharge may be dimensionally shifted with respect to the focal point.

19. The optical system in claim 18, wherein the second power driving condition provides power at a frequency determined by the formula:

$f_l=(c/2L)k$ where:

c=the velocity of sound in the enclosed media, at the temperature and pressure of operation k=an integer equal to or greater than 1.

20. The optical system in claim 18, wherein the second power driving condition provides power at a frequency determined by the formula:

$f_r=(1.84c/2\pi R)n$ where:

c=the velocity of sound in the enclosed media, at the temperature and pressure of operation n=an integer equal to or greater than 1.

21. The optical system in claim 18, wherein the second power driving condition provides power at a frequency determined by the formula:

$f_a=(3.83c/2\pi R)m$ where:

c=the velocity of sound in the enclosed media, at the temperature and pressure of operation m=an integer equal to or greater than 1.

* * * * *